US007181874B2

(12) United States Patent
Uebele et al.

(10) Patent No.: US 7,181,874 B2
(45) Date of Patent: Feb. 27, 2007

(54) MULTIPURPOSE DRIP IRON

(75) Inventors: Volkmar Uebele, Bad Nauheim (DE); Klaus Maier, Offenbach (DE); Reinhard Ahlers, Offenbach (DE)

(73) Assignee: Rowenta Werke GmbH, Offenbach (DE)

( * ) Notice: Subject to any disclaimer, the term of this patent is extended or adjusted under 35 U.S.C. 154(b) by 0 days.

(21) Appl. No.: 10/530,686

(22) PCT Filed: Sep. 30, 2003

(86) PCT No.: PCT/IB03/04305

§ 371 (c)(1),
(2), (4) Date: Jan. 19, 2006

(87) PCT Pub. No.: WO2004/033786

PCT Pub. Date: Apr. 22, 2004

(65) Prior Publication Data

US 2006/0156591 A1 Jul. 20, 2006

(30) Foreign Application Priority Data

Oct. 8, 2002 (FR) ..... 02 12449

(51) Int. Cl.
*D06F 75/18* (2006.01)
*D06F 75/24* (2006.01)

(52) U.S. Cl. ..... 38/77.82; 38/77.83

(58) Field of Classification Search ..... 38/74, 38/77.1, 77.3, 77.8, 77.83, 77.82
See application file for complete search history.

(56) References Cited

U.S. PATENT DOCUMENTS

| | | | | |
|---|---|---|---|---|
| 4,125,953 | A * | 11/1978 | Colombo | 38/77.7 |
| 4,627,181 | A * | 12/1986 | Bastida | 38/77.7 |
| 4,780,973 | A * | 11/1988 | Vildosola | 38/77.7 |
| 6,105,286 | A * | 8/2000 | Ching et al. | 38/77.83 |
| 6,167,643 | B1 * | 1/2001 | Dodier et al. | 38/77.8 |
| 6,763,620 | B1 * | 7/2004 | Voss et al. | 38/77.83 |

FOREIGN PATENT DOCUMENTS

| | | |
|---|---|---|
| DE | 297 20 259 U1 | 2/1998 |
| FR | 2 589 492 | 5/1987 |
| FR | 2 769 925 | 4/1999 |
| FR | 2 821 368 | 8/2002 |
| WO | WO 99/45190 A1 | 9/1999 |

* cited by examiner

*Primary Examiner*—Ismael Izaguirre
(74) *Attorney, Agent, or Firm*—Browdy and Neimark, PLLC

(57) ABSTRACT

The invention concerns a steam iron comprising a water reservoir (1), a hydraulic circuit (3) connecting the reservoir (1) to an electrically heated vaporization chamber (23), the circuit including in series an anti-drip valve (4), and an adjustable drip element (5) capable, in a self-cleaning position, of opening allowing a free passageway and supplying water to said chamber. The invention is characterized in that the drip element comprises means for opening or maintaining open the anti-drip valve (4), when it is in the self-cleaning position.

6 Claims, 4 Drawing Sheets

MULTIPURPOSE DRIP IRON

The present invention relates to steam pressing irons in which water provided by a reservoir is vaporized in a quasi-instantaneous manner in a steam chamber, the flow of water from the reservoir towards the steam chamber being controlled by a drip device.

Sophisticated irons also have a drip preventing device that halts the flow of water to be vaporized when the steam chamber is insufficiently hot, in order to avoid spattering of water on items being ironed. A simple thermostatic device fulfilling this function consists of a bimetallic strip subjected to the heating of the steam chamber and which opens a drip preventing valve disposed in series with the drip device.

Sophisticated irons have moreover self-cleaning means to clean the interior of this chamber. These means consist of a relatively wide opening formed in the bottom of the internal water reservoir by which one can quickly empty said reservoir into the steam chamber, thus causing a vapor and water jet, which purges the iron. The flow of water from the reservoir towards the chamber must then be able to continue in spite of abrupt cooling of the steam chamber and the closing of the drip preventing valve.

The patent FR2589492 describes an iron having a drip device which controls the flow of water into the steam chamber. The drip device is in series with a drip preventing valve mounted on a rocking lever actuated by a bimetallic strip sensitive to the temperature of the chamber. But this iron does not have a self-cleaning device and the drip preventing device systematically closes the water circuit when the chamber cools.

The patent FR2769925 describes an iron having a self-cleaning function constituted by a self-cleaning valve formed by an elastomer bell surrounding the drip device and capable of short-circuiting it. But the iron does not have a drip preventing device.

The patent DE29720259 describes an iron in which the drip function and the cleaning function are obtained by the same control which operates the needle of the drip device in a first part of its travel travel path and provokes self-cleaning in a second part, thus simplifying the apparatus. But this iron does not comprise a drip preventing device.

The patent W09945190 describes an iron having a drip device, a drip preventing device and a self-cleaning function. But the iron has two controls and a valve that short-circuits the drip preventing device to fulfill all of these functions.

The patent FR2821368 describes an iron having a drip device, a drip preventing device and a self-cleaning function. But this function is fulfilled by means of a bellows with an end forming a valve, thus an additional joint that must be watertight.

The object of the invention herebelow is an improved iron, having a drip device, a drip preventing device and a self-cleaning device, very simple to use, having a minimum of components for an economic and reliable design.

The goal of the invention is achieved by a steam pressing iron comprising a water reservoir, a hydraulic circuit connecting the reservoir to an electrically heated steam chamber, the circuit comprising in series a drip preventing valve, and an adjustable drip device capable, in a self-cleaning position, of opening to leave a free and generous passage for water towards said chamber, noteworthy in that the drip device has means to open or maintain open the drip preventing valve, when it is placed in the self-cleaning position.

Due to these means, a valve to short-circuit the drip preventing device is not necessary, the number of hydraulic components is reduced and the reliability increased.

Preferably, the drip device is adjustable by a control having a travel path in two parts, the first part allowing limitation and adjustment of the flow rate of water for vaporization, the second part producing the free and generous passage for water towards said steam chamber.

The iron is then easy to use, with a reduced number of controls.

Preferably, the means for opening or maintaining open the drip preventing valve have a lever capable of opening the drip preventing valve by one of its ends and actuated by a movable element of the drip device by the other end.

In a preferential version, the stem of the drip device has a lug that acts on the lever in the second part of its travel path.

In another version, the stem of the drip device is surrounded by a module having an abutment to act on the lever, the module opening a wide passage for water in the second part of the travel path.

Preferably, the drip preventing device has a thermostatic device constituted by a bimetallic strip subjected to the temperature of the steam chamber, and which opens the valve when the chamber is at sufficient temperature to obtain a good vaporization.

Preferably, the drip preventing device has an elastic element that urges the valve to bear against the bimetallic strip or in a closing position, and the lever acts against this elastic element.

In this way, the lever does not exert any constraint on the bimetallic strip which is relieved of the force of opening of the valve at the beginning of self-cleaning.

The invention will be better understood in view of the examples herebelow and of the annexed drawings.

Figure 1:
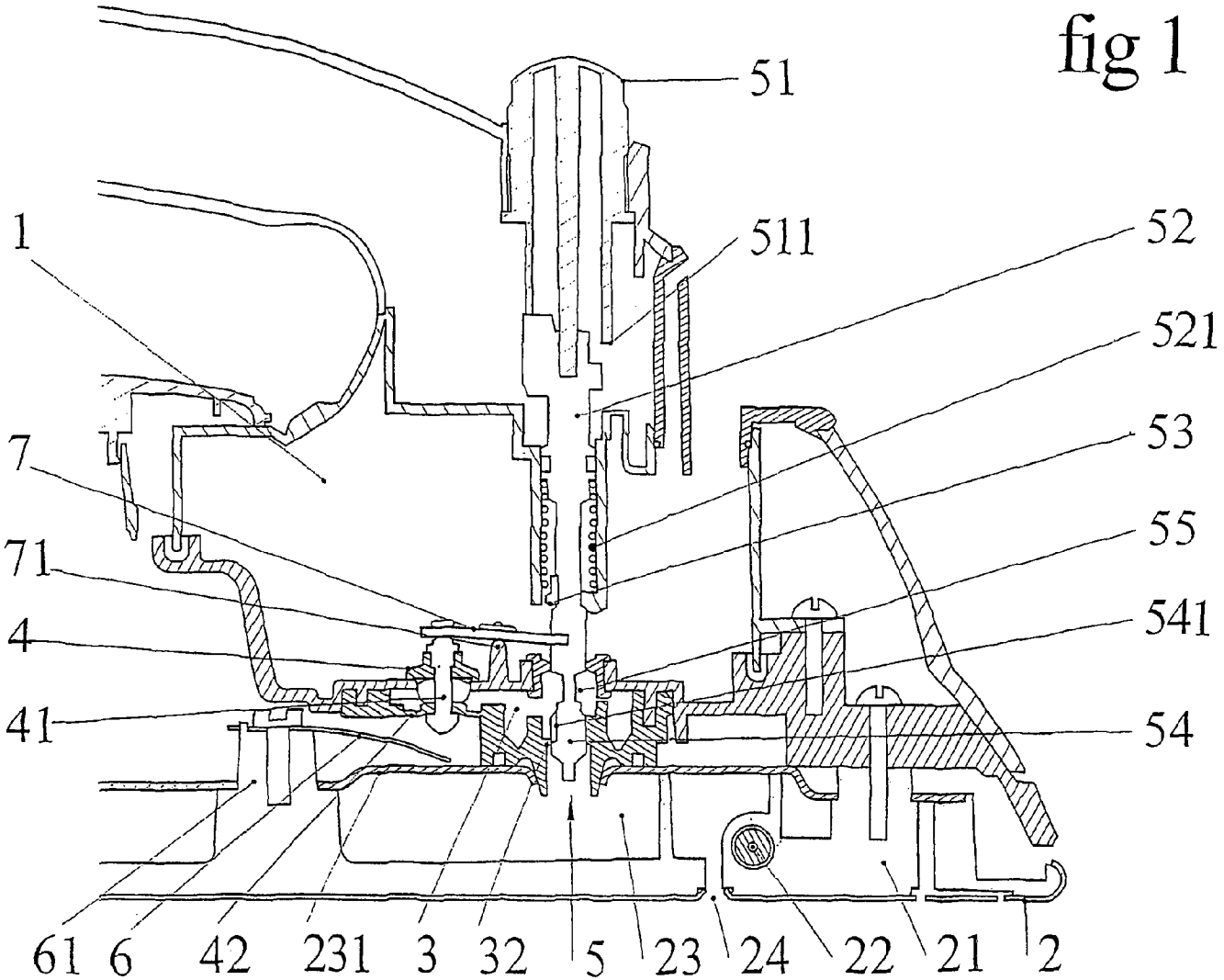
FIG. 1 is a partial view in longitudinal cross section of an iron according to a first version of the invention, the iron being cold and at rest.
Figure 3:
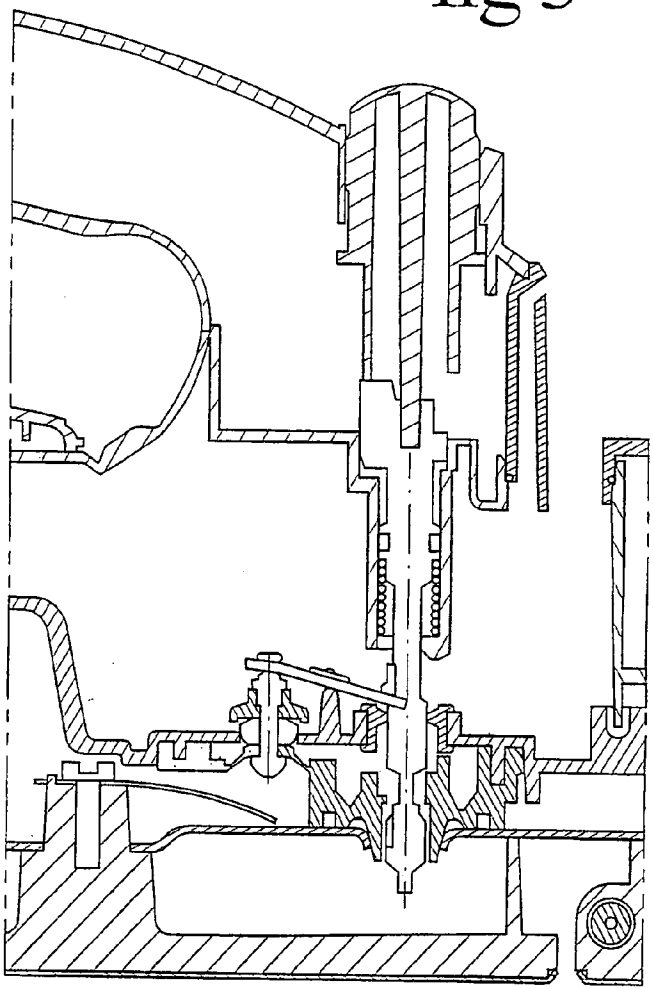
FIG. 3 is a detail view of the iron of FIG. 1, the iron being in the self cleaning position.
Figure 2:
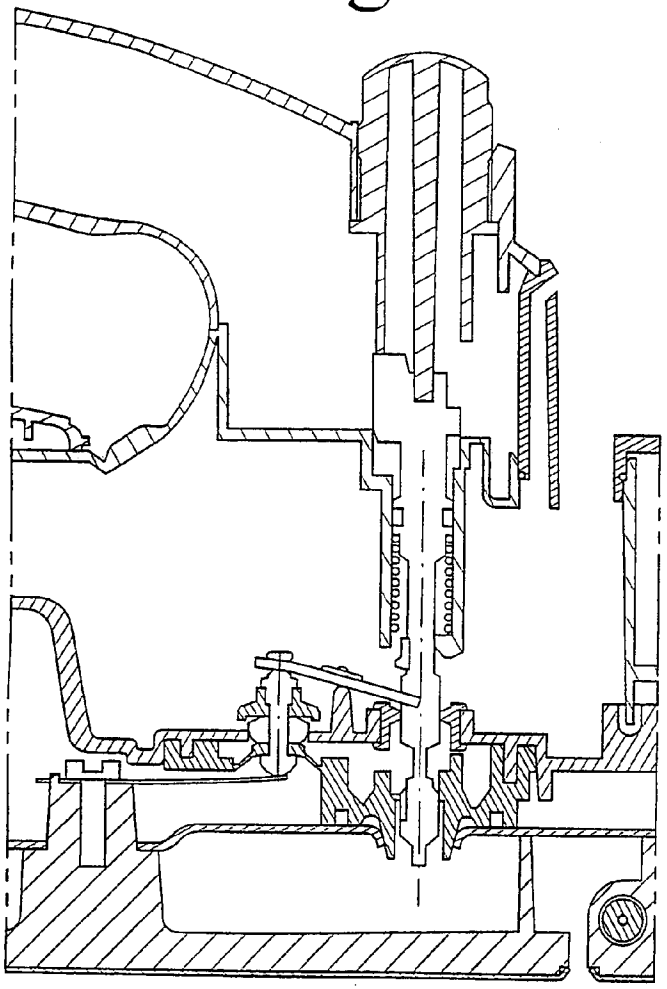
FIG. 2 is a detail of the iron of FIG. 1, the iron being hot and steaming normally.

In a first version of the invention visible in FIGS. 1 to 3, the iron has a reservoir 1 of water to be vaporized, a soleplate 2 provided with a body 21 heating under the action of an electric heater 22. A steam chamber 23 closed by a plate 231 is arranged in heating body 21. Channels connect steam chamber 23 to steam outlet openings 24.

Reservoir 1 is connected to steam chamber 23 by a hydraulic system 3 comprising in series a drip preventing valve 4 having a shank 41, and a drip device 5. Valve 4 is normally held in the closed position, as represented in FIG. 1, by the elasticity of a membrane 42, which constitutes a wall of circuit 3.

A thermostatic drip preventing device is constituted by a bimetallic strip 6 fixed, at one of its ends, to the walls of chamber 23 by a thermally conducting boss 61. The other end of bimetallic strip 6 is capable of acting on the stem of valve 4, against the elasticity of membrane 42, to open it when the iron is hot, as represented in FIG. 2.

Drip device 5 has a control 51 capable of moving along its axis a stem 52 which carries a lug 53. The end of the stem is a plug 54 provided locally with a groove 541 of variable cross section. The plug slides along its axis, in a first part of the control travel path, on a lip 32 of an outlet opening of circuit 3 into the steam chamber, which makes it possible to control the water flow rate, as represented in FIGS. 1 and 2. Stem 52 presents above plug 54 a narrowing 55 which leaves a large passage for flow of the water when the plug escapes lip 32 in a second part of the travel path.

Control 51 is a button that carries a cam 511 at its end. The first part of the control travel path which allows adjustment of the water flow rate, is obtained by turning the button. In this movement, cam 511 pushes back stem 52 against the action of a spring 521 and positions it in a stable way, as represented in FIGS. 1 and 2, plug 54 remaining in contact with lip 32.

The second part of the control travel path is obtained by depressing button 51 along its axis, as represented in FIG. 3. The plug escapes then from the lip 32, to which corresponds narrowing 55 of stem 52. At the same time, pin 53 pushes the end of a tilting lever 7 on the crest of a rib 71. The other end of lever 7 is coupled to shank 41 of valve 4, which is then maintained open whatever the state of bimetallic strip 6.

To use the pressing iron, the user fills reservoir 1. Cold bimetallic strip 6 is in the position of FIG. 1 and valve 4 is closed by the action of membrane 42. The user can preset the water flow rate of drip device and thus the vapor flow rate by turning the control button 51 to the desired value. Lip 32 of the opening of the drip device is in correspondence with part of the plug 54 where groove 541 has a cross section appropriate to the desired flow rate. When the iron warms up enough to produce a good vaporization of water, bimetallic strip 6 deflects and pushes back shank 41 of valve 4 to open it, as represented in FIG. 2. Water can then flow out from reservoir 1 through valve 4, circuit 3 and the passage of drip device 5 whose cross section is controlled by lip 32. The user can iron normally.

When the user decides to effect self-cleaning of her iron, she depresses button 51 against spring 521. Plug 54 escapes from lip 32 which is then in correspondence with narrowing 55, freeing a large free passage for water coming from reservoir 1. At the same time, lug 53 of the stem of the drip device comes to bear against an end of lever 7, the other end raising, or maintaining raised, valve 4 against the elasticity of membrane 42. The iron cools quickly, the partially vaporized water in the chamber 23 causes cleaning of the iron, and the bimetallic strip separates from shank 41. But this shank being maintained by lever 7, valve 4 remains open during all of the cleaning operation, which allows it to be completed properly.

As soon as the user releases button 51, this latter moves back under the action of spring 521. Lug 53 is entrained in the same movement, and lever 7 releases the valve 4 which closes until the iron is again sufficiently hot so that bimetallic strip 6 opens it and again allows normal vaporization.

Figure 4:
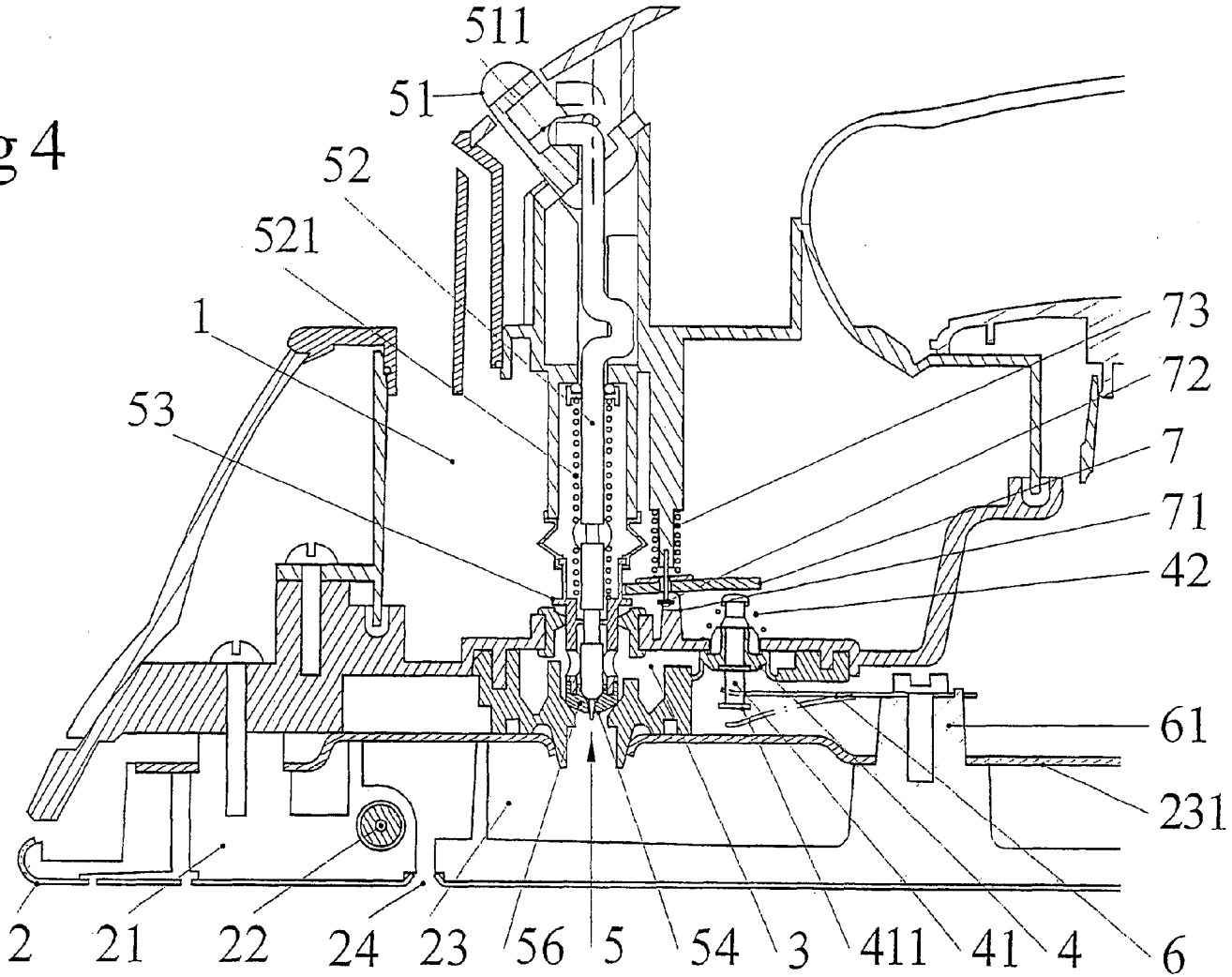
FIG. 4 is a partial view in longitudinal cross section of an iron according to a second version of the invention, the iron being cold and at rest.
Figure 5:
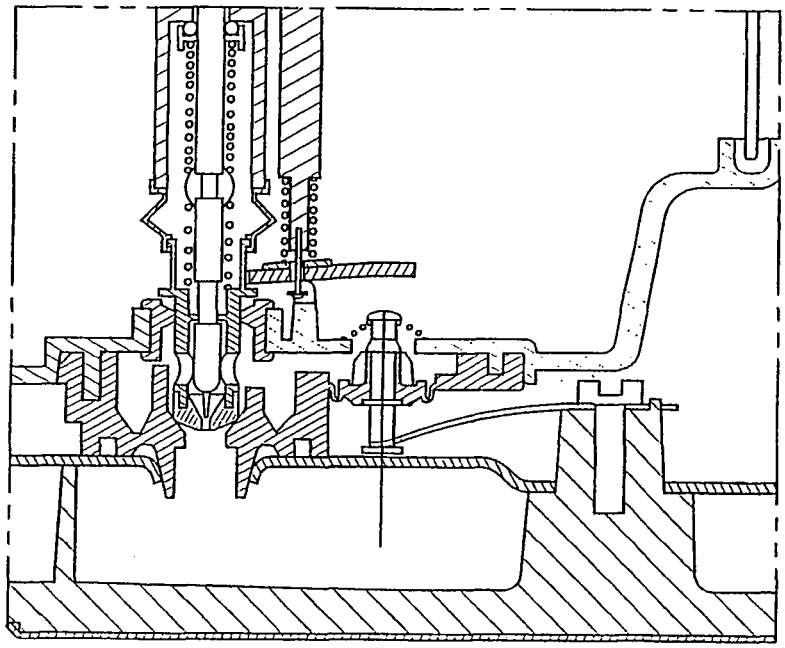
FIG. 5 is a detail of the iron of FIG. 4, the iron being hot and steaming normally.
Figure 6:
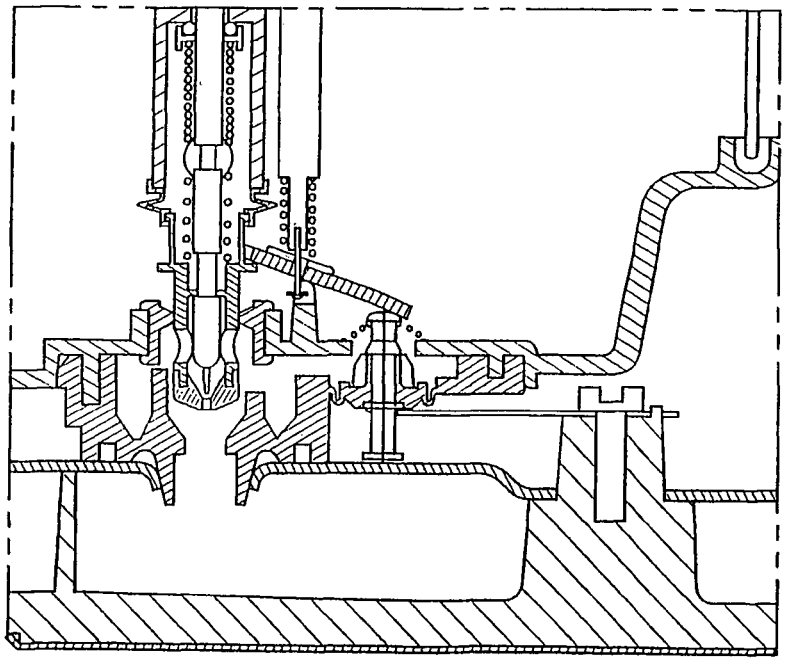
FIG. 6 is a detail of the iron of FIG. 4, iron being in the self cleaning position.

In a second version of the invention, visible in FIGS. 4 to 6, the iron has a reservoir 1 for water to be vaporized, a soleplate 2 provided with a body 21 heating under the action of an electric heater 22. A steam chamber 23 closed by a plate 231 is arranged in heating body 21. Channels connect steam chamber 23 to steam outlet openings 24.

Reservoir 1 is connected to steam chamber 23 by a hydraulic system 3 comprising in series a drip preventing valve 4 having a shank 41 a lower end of which is provided with a shoulder 411, and drip device 5. Valve 4 is normally held in the closed position, by a spring 42, as represented in FIG. 4.

A thermostatic drip preventing device is constituted by a bimetallic strip 6 fixed, at one of its ends, to the walls of chamber 23 by a thermally conducting boss 61. The other end of bimetallic strip 6 has a fork capable of acting against spring 42 on the stem of valve 4 while resting on shoulder 411, to open said valve when the iron is hot, as represented in FIG. 5.

Drip device 5 has a control 51 that carries a cam 511, having a notched part on a first part of the travel path and a smooth part and steep slope on a second part of the travel path. The cam makes it possible to move a stem 52 along its axis, against the action of a spring 521. The end of stem 52 is a needle that controls the passage cross section of an opening 54 arranged in a module 56 surrounding the needle, the module being capable of hanging on stem 52 and rising to free a large water passage through the drip device. In a first part of the control travel path, stem 52 moves the needle, while the module closes the large passage, which makes it possible to control the water flow rate, as represented in FIGS. 4 and 5.

In a second part of the travel path, stem 52 raises module 56, as long as the user maintains the control. Moreover, module 56 presents a shoulder 53 lifting the end of a lever 7 pivoting on the crest of a rib 71. The other end of lever 7 bears on an end of shank 41 of valve 4 which is then maintained open whatever the state of bimetallic strip 6, as one can see in FIG. 6.

Reservoir 1 is in two parts, an upper part and a lower part. To facilitate the assembly of the drip device, lever 7 and, inter alia, module 56 are assembled on the upper part prior to the closing of the reservoir. For this purpose lever 7 is maintained to the assembly by a spring 73 and screw 72 lightly fastened to the upper part. Upon closing of the reservoir, spring 73 is compressed and maintains lever 7 flattened on the crest of rib 71 belonging to the lower part.

To use the pressing iron, the user fills reservoir 1. Cold bimetallic strip 6 is in the position of FIG. 4 and valve 4 is closed by the action of spring 42. The user can preset the water flow rate of the drip device and thus the steam flow rate by turning control knob 51 to the desired value. The needle of the drip device provides a passage cross section appropriate to the desired water flow rate. When the iron warms up enough to produce a good vaporization of water, bimetallic strip 6 deflects and pulls shank 41 of valve 4 to open it, as represented in FIG. 5. Water can then flow from reservoir 1 through valve 4, circuit 3 and the passage of drip device 5 whose cross section is controlled by the needle. The user can iron normally.

When the user decides to produce self-cleaning of her iron, she pushes button 51 towards the end of its travel path. The module is raised freeing a large free passage for water coming from reservoir 1. At the same time, shoulder 53 of the module comes to bear against one end of lever 7, the other end raising, or maintaining raised, valve 4 against spring 42. The iron cools quickly, the partially vaporized water in chamber 23 causes the cleaning of the iron, and the bimetallic strip separates from shoulder 411 of shank 41. But this shank being maintained by lever 7, valve 4 remains open during all of the cleaning operation, which allows it to be completed properly.

As soon as the user releases button 51, the latter moves back under the action of spring 521, entraining the closing of the module. Shoulder 53 is entrained in the same movement, and lever 7 releases valve 4 which closes, until the iron is again sufficiently hot so that bimetallic strip 6 opens it and again allows normal vaporization.

The invention claimed is:

1. A steam pressing iron comprising a water reservoir (1), a hydraulic circuit (3) connecting the reservoir (1) to an electrically heated steam chamber (23), the circuit (3) comprising in series a drip, preventing valve (4), and an adjustable drip device (5) capable, in a self-cleaning position, of opening to leave a free and generous passage for water towards said chamber (23), wherein the drip device (5) has means coupled to the drip preventing valve for opening or maintaining open the drip preventing valve (4), when it is placed in the self-cleaning position.

2. The iron according to claim 1 characterized in that the drip device (5) is adjustable by a control having a travel path in two parts, the first part allowing limitation and adjustment of the flow rate of water for vaporization, the second part producing the free and generous passage for water towards said steam chamber (23).

3. The iron according to claim 1 characterized in that the means for opening or maintaining open the drip preventing valve have a lever (7) capable of opening the drip preventing valve (4) by one of its ends and actuated by a movable element of the drip device (5) by the other end.

4. The iron according to claim 3 characterized in that the stem (52) of the drip device (5) has a lug (53) capable of acting on the lever (7).

5. The iron according to claim 3 characterized in that the stem (52) of the drip device (5) is surrounded by a module (56) opening a wide passage for water in the second part of the travel path characterized in that the module (56) has an abutment (53) capable of acting on the lever (7).

6. The iron according to claim 1 characterized in that the drip preventing device has an elastic element (42) that urges the valve (4) to bear against a bimetallic strip (6) or in a closing position, and the lever (7) acts against this elastic element (42).

* * * * *